United States Patent [19]

Skinner

[11] 4,029,896

[45] June 14, 1977

[54] TERMINAL HOUSING FOR AN ELECTRICAL RESISTANCE HEATER

[75] Inventor: Charles A. Skinner, Columbia, Md.

[73] Assignee: Electro-Therm, Inc., Laurel, Md.

[22] Filed: Oct. 22, 1975

[21] Appl. No.: 624,697

[52] U.S. Cl. ..... 174/138 F; 174/92; 219/451; 219/541; 339/105; 339/208

[51] Int. Cl.[2] ..... H01R 13/48; H05B 3/06; H01R 13/58

[58] Field of Search ..... 174/5 R, 88 S, 92, 138 F; 219/451, 541; 339/36, 103 C, 103 M, 105, 107, 116 R, 116 C, 141, 208

[56] References Cited

UNITED STATES PATENTS

| | | | |
|---|---|---|---|
| 964,969 | 7/1910 | Hesterhagen | 174/92 X |
| 2,043,851 | 6/1936 | Grant et al. | 339/107 X |
| 2,475,184 | 7/1949 | Hudson | 174/92 |
| 2,962,542 | 11/1960 | Witt | 174/92 X |
| 3,184,580 | 5/1965 | Hanson | 219/451 |
| 3,569,914 | 3/1971 | Taylor et al. | 339/107 |
| 3,617,703 | 11/1971 | Ewart, Jr. | 219/451 |
| 3,812,321 | 5/1974 | Skinner | 219/451 |

FOREIGN PATENTS OR APPLICATIONS

| | | | |
|---|---|---|---|
| 2,127,865 | 12/1971 | Germany | 174/92 |
| 816,918 | 7/1959 | United Kingdom | 174/92 |

*Primary Examiner*—Laramie E. Askin
*Attorney, Agent, or Firm*—Richard G. Kinney; Eugene M. Cummings; Henry W. Collins

[57] ABSTRACT

A terminal housing for surface-type resistance heating elements includes interlocking housing sections which snap together to form compartments in which connections to the heating elements are mechanically and electrically protected. The use of identical housing sections with integral locking and strain relief provisions allows the terminal housing to be used with a wide variety of types of connections without the need for a large inventory of components.

3 Claims, 12 Drawing Figures

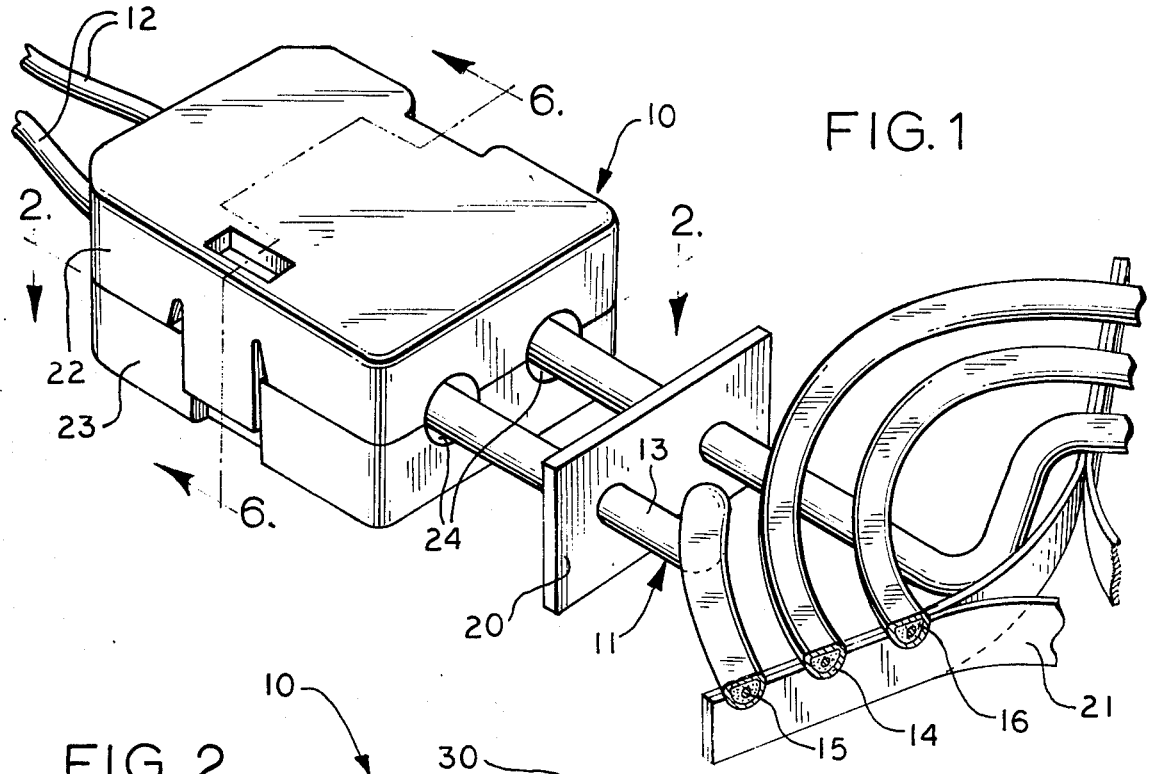
FIG. 1
FIG. 2
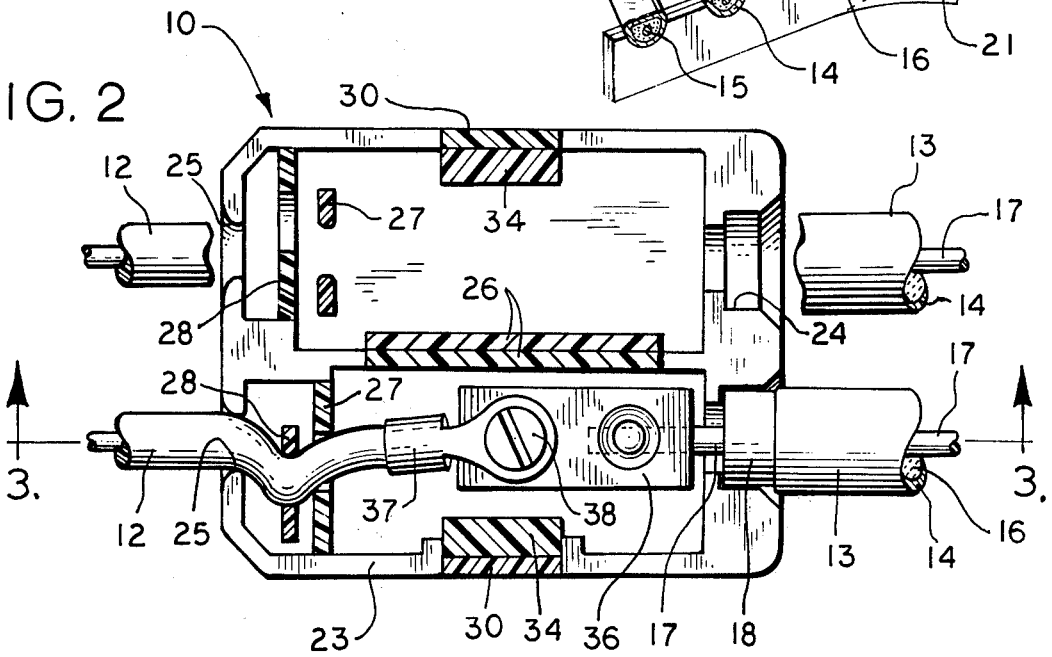
FIG. 3
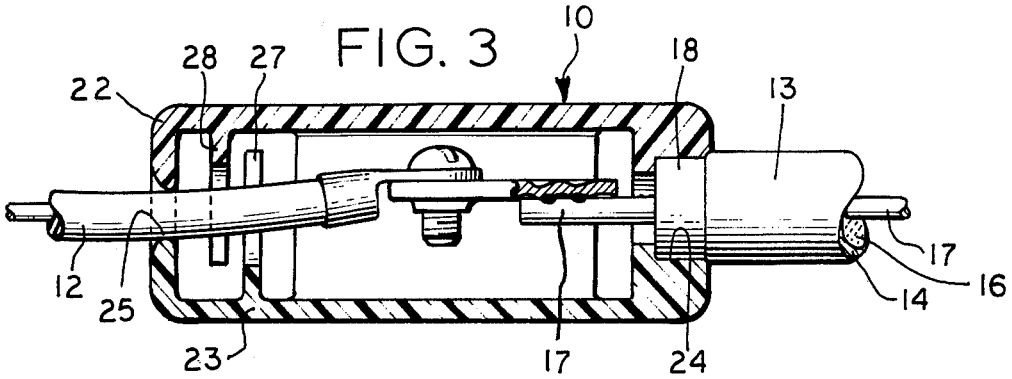

FIG. 4
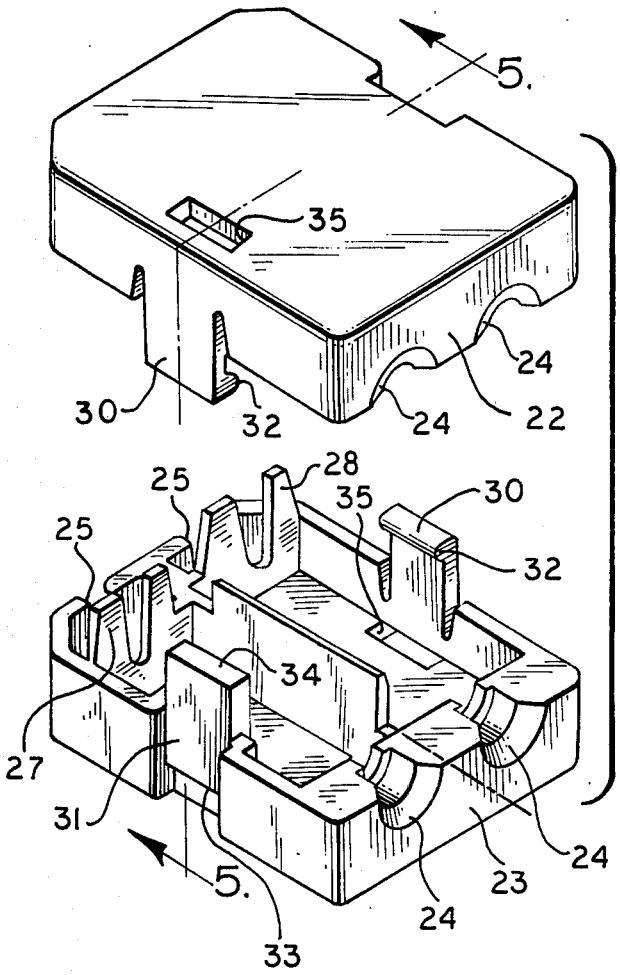
FIG. 5
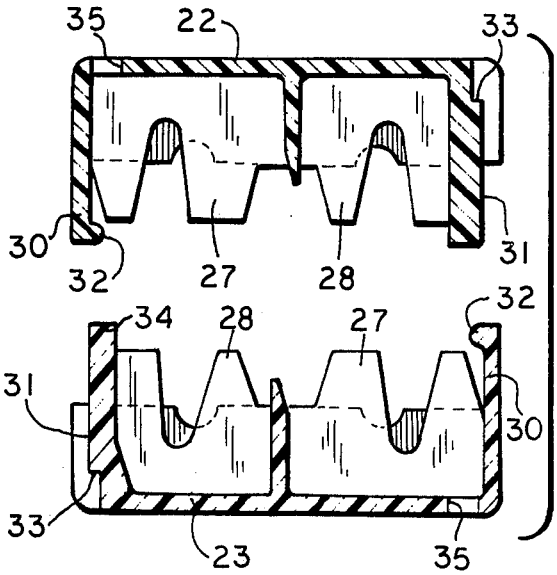
FIG. 6
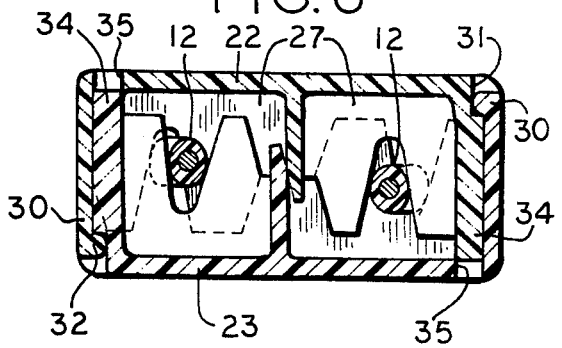
FIG. 7a
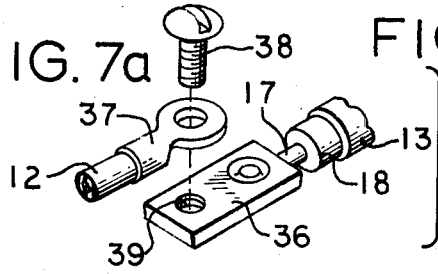
FIG. 7b
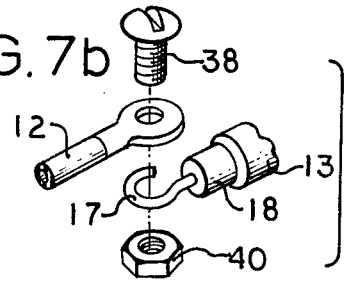
FIG. 9
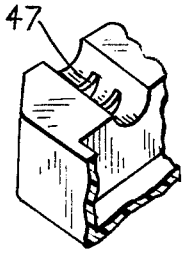
FIG. 7c
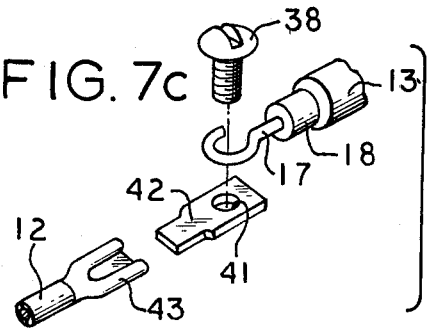
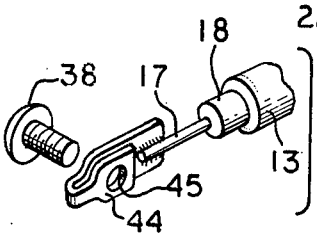
FIG. 7d
FIG. 8
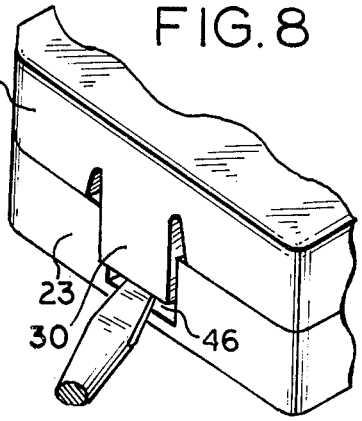

TERMINAL HOUSING FOR AN ELECTRICAL RESISTANCE HEATER

BACKGROUND OF THE INVENTION

The present invention is directed generally to electric heating element assemblies, and more particularly to a housing for enclosing the connections between the end terminals of a sheathed resistance heating element and electrical lead wires.

Surface-type electric heating elements, which are widely used in electric ranges, hot plates and similar appliances, usually comprise an elongated tubular sheath containing a resistance wire which is electrically insulated from and held in position within the sheath by a concentric layer of compacted refractory material. The heating element is formed into a flat winding and electrical connections are established with the resistance wire at the ends of the element by means of terminal pins fitted into the ends.

To supply electrical power to the heating element, the terminal pins are connected to a source of electrical energy. This may be accomplished by either plugging the terminal pins into a socket for contact with spring contacts carrying electrical current, or by connecting the terminal pins to lead wires by means of individual screw connections. When the terminal pins are connected by means of screw connections the connections are ordinarily protected from inadvertent contact and mechanical misalignment by being enclosed within an electrically non-conductive housing. One such housing is described in U.S. Pat. No. 3,812,321 issued to the present applicant on May 21, 1974, and assigned to the present assignee.

Unfortunately, prior-art terminal housings have not been completely satisfactory in the replacement market, wherein many different types and sizes of interconnections are encountered. For this reason, a need has developed for a universal terminal housing which can accommodate many different types of connections without the need for additional clips, straps, retainers or adapters, thus relieving the service man from the necessity of stocking many different types of terminal housings and accessories. The present invention is directed to such a universal terminal housing which utilizes only one type of housing section and does not require additional clamps or locking members.

SUMMARY OF THE INVENTION

The present invention is directed to a housing for enclosing the connections between first and second electrical conductors and first and second end terminals of a heating element. The housing comprises first and second interlocking non-conductive housing sections defining a housing having a pair of interior compartments, the housing including a first pair of apertures opening into respective ones of the compartments for receiving respective ones of the heating element terminals, and a second pair of apertures opening into respective ones of the compartments for receiving respective ones of the electrical conductors, the first and second conductors being connected to the first and second terminals within the first and second compartments, respectively.

The invention is further directed to a housing for enclosing the connections between an electrical conductor and the end terminals of a resistance heating element. The housing comprises first and second interlocking non-conductive housing sections defining a housing having an interior compartment, the housing including a first aperture opening into the compartment for receiving the end terminal of the electrical heating element, and a second aperture opening into the compartment for receiving the electrical conductor, the heating element being connected to the electrical conductor within the compartment.

The invention is further directed to a surface-type electric heating element assembly for connection to a pair of electrical conductors. The assembly comprises a sheathed electrical heating element having a pair of terminal pins, a housing comprising first and second identical molded interlocking housing sections defining a housing having a pair of interior compartments, the housing including a first pair of apertures opening into respective ones of the compartments for receiving respective ones of the terminal pins, a second pair of apertures opening into respective ones of the compartments for receiving respective ones of the conductors, and integral locking means including a projecting portion and a receiving portion disposed in diametrically opposed relationship on each of the housing sections for locking the housing sections together.

BRIEF DESCRIPTION OF THE DRAWINGS

The features of the present invention, which are believed to be novel, are set forth with particularity in the appended claims. The invention, together with the further objects and advantages thereof, may best be understood by reference to the following description taken in connection with the accompanying drawings, in the several figures of which like reference numerals identify like elements, and in which:

FIG. 1 is a perspective view showing a terminal housing constructed in accordance with the invention in conjunction with a surface-type resistance heating element assembly.

FIG. 2 is a cross-sectional view of the terminal housing taken along line 2—2 of FIG. 1.

FIG. 3 is a cross-sectional view of the terminal housing taken along line 3—3 of FIG. 2.

FIG. 4 is an exploded perspective view of the terminal housing.

FIG. 5 is a cross-sectional view taken along line 5—5 of FIG. 4 showing the terminal housing in an open or uninstalled condition.

FIG. 6 is a view similar to FIG. 5 showing the terminal housing in a closed or installed condition.

FIGS. *7a–7d* illustrate various types of electrical connections between the resistance heating element and the lead wires which can be accommodated by the terminal housing.

FIG. 8 is a fragmentary perspective view of a portion of the terminal housing in a locked condition showing an alternate construction for the integral locking means of the terminal housing sections.

FIG. 9 is a fragmentary perspective view of a terminal housing section showing an alternate construction for the integral lead wire retaining means provided therein.

DESCRIPTION OF THE PREFERRED EMBODIMENT

Referring to the figures, and particularly to FIGS. 1–3, a terminal housing 10 constructed in accordance with the invention is shown in conjunction with a conventional surface-type resistance heating element assembly 11 and a pair of electric conductors in the form of flexible lead wires 12. Assembly 11, which may be entirely conventional in design and construction, includes a conventional resistance heating element 13 having an elongated tubular metal sheath 14 which contains an axially disposed resistance wire 15 (FIG. 1) which is electrically insulated from and held in position within the sheath by a concentric sleeve 16 of compacted refractory material. In accordance with conventional practice, the heating element is arranged in the form of a flat winding with its end portions disposed below and extending laterally from the flat winding. Opposite ends of the resistance wire are connected to terminal pins 17, each of which has a portion disposed within the sheath and a portion extending beyond the end of the sheath. Insulating bushings 18 may be positioned over the terminal pins within the ends of the sheath as shown in FIGS. 2 and 3.

Usually, a metal strip 20 is connected across the terminal portions of the sheath, as shown in FIG. 1, to hold these portions in a definite spaced relationship. Ordinarily, only one end of the sheath is bonded to the strip to provide for expansion and contraction of the sheath without lateral deformation of the flat winding. An additional support bracket 21 may be provided beneath the coil to maintain the coil in horizontal alignment during use.

Referring to FIGS. 2 and 3, terminal housing 10 is formed by two identical interlocking housing sections 22 and 23. These are preferably formed of a heat resistant electrically non-conducting material, such as silicone resin, or a phenolic plastic, by conventional molding techniques. When locked together, these housing sections define a generally rectangular terminal housing within which the connections between the terminal pins 17 of heating element 13 are connected to respective ones of lead wires 12, the side walls and bases of the housing sections forming side walls and end walls of the housing, respectively.

The ends of heating element 13 enter terminal housing 10 through a pair of spaced apertures 24 which extend through one side wall of the housing. Lead wires 12 enter the housing through a second pair of apertures 25 which extend through the opposite side wall of the housing. Apertures 24 may be chamfered along their outside edge to more readily receive the ends of sheath 14, and may be stepped down to a smaller diameter to provide a ridge or shoulder against which the dielectric bushings 18 can be brought to bear for improved mechanical rigidity and protection against accidental probing of the electrical connections contained within when the terminal housing is installed on a heating element assembly.

To provide protection against undesirable fraying of the insulation of lead wires 12 as they enter terminal housing 10, the outermost edges of apertures 25 are rounded. The lead wires 12 extend through these apertures and into the interior of the housing wherein they are connected to respective ones of the end pins of heating element 13. To provide electrical isolation between these connections, housing sections 22 and 23 are preferably provided with interior divider walls 26 such that when the housing sections are joined, two separate compartments are formed within the housing. As shown in FIG. 2, these divider walls are set to one side of the center line of the housing sections so that when the sections are joined, the divider walls of the joined sections are positioned side-by-side within the interior of the resulting terminal housing.

To retain lead wires 12 in position and prevent strain forces exerted on the lead wires from being transferred to the electrical connections within the terminal housing, with the attendant danger of the connections being loosened, housing sections 22 and 23 are provided with strain relief means in the form of internal integrally molded retaining walls 27 and 28. As best shown in FIG. 2, these retaining walls include notches which direct the incoming lead wires 12 to one side of apertures 25 prior to their being connected to the end terminals of the heating element assembly. As a result, a frictional engagement is obtained between the terminal housing and the lead wires such that forces exerted on the lead wires are not transmitted to the electrical connections.

Referring to FIG. 4, the two housing sections 22 and 23 are locked together by integrally molded means in the form of a projecting tab portion 30 and tab-receiving portion 31 on opposite side walls of the housing sections. The tab portion 30 includes an inwardly projecting detent 32 adapted to bear against a complementarily dimensioned slot 33 included in the tab-receiving portion of the interlocked housing section to form a snap-fit engagement. Furthermore, the tab-receiving portions may include projecting guides 34 which extend into slots or apertures 35 in the adjacent housing section. Since no tools, locking hardware or clamps are required to maintain the housing sections in engagement, and the complementary nature of the tab and tab-receiving portions of the housing sections allows the housing sections to be identical, the need for stocking multiple components is obviated.

In installing a terminal housing the tab portions 30 of two housing sections are aligned with their corresponding tab-receiving portions 31 and the housing sections are pressed together until the tab portions snap into positions against their coacting ledges 33. The projecting guide portions 34 extend into the adjacent housing as this operation is performed, providing additional rigidity to the engaged housing sections.

To separate housing sections 22 and 23 once they have been assembled, it is necessary to insert a screwdriver or similarly pointed object adjacent the detent 32 of the tab portion 30 of one housing section so as to force the resilient tab away from its interlocking ledge 33 on the other housing. The same operation is next performed on the tab portion of the other housing section. The two housing sections can then be pulled apart.

Various types of electrical connections can be accommodated within terminal housing 10. A spot-welded flat terminal construction is shown in FIGS. 2, 3 and 7*a*, wherein a flat terminal 36 is spot-welded to terminal pin 17 and a closed lug 37 is provided at the end of lead wires 12 for receiving a machine screw 38 threaded into an aperture 39 in the terminal. A buttonhook-type connection is shown in FIG. 7*b*, wherein a machine screw 38 is threaded through lug 37 and the buttonhook end of terminal pin 17 into a nut 40. A buttonhook and spade lug connection is shown in FIG. 7*c*, wherein a machine screw 38 is threaded through the buttonhooked end of terminal pin 17 into a complementarily threaded aperture 41 in a terminal 42 and lead wire 12 is provided with a spade lug 43 which fits over a projecting tab on terminal 42. Terminal housing 10 can also be utilized in conjunction with a compression-type terminal blade connector such as that shown in FIG. 7*d* wherein terminal pin 17 is spot-welded to a terminal 44 of folded-over construction, machine screw 38 being threaded into an aperture 45 provided on the folded-over portion of the terminal, as shown and described in the aforementioned U.S. Pat. No. 3,812,321, and in an improved form in the co-pending application of the present applicant, Ser. No. 636,475 filed Dec. 15, 1975, and assigned to the present assignee.

It will be appreciated that alternate constructions are possible for locking housing sections 22 ad 23 together. For example, as shown in FIG. 8 the projecting tab portion 30 can be shortened so as to engage a detent (not shown) provided near the center of the adjacent side wall. A slit-like depression 46 can be provided on the interlocking housing section immediately adjacent the end of the shortened tab portion to allow a screwdriver or similar tool to be inserted and brought to bear against the tab portion to separate the housing sections.

Other arrangements are also possible for the interior walls utilized to provide strain relief for lead wires 12. For example, as shown in FIG. 9, a plurality of integral ring-like wall segments 47 can be arranged to bear against the lead wires to achieve the necessary frictional engagement between the lead wires and the housing sections.

While terminal housing 10 has been shown as being generally rectangular in form and having two isolated compartments for use in conjunction with the two ends of a single-unit heating element 13 and two interconnecting lead wires 12, it will be appreciated that other forms, such as round or oval forms, having a lesser or greater number of interconnections, can also be provided. For example, it would be possible to provide a single compartment within a rectangular or oval shaped terminal housing and to utilize separate terminal housings for each connection to heating element 13. Also, it would be possible to connect more than one heating element through a single terminal housing, in which case three or more separate compartments could be provided in the terminal housing, or isolation between one or more of the connections could be dispensed with.

By reason of the two housing sections being identical and self-locking, it is necessary to stock only a single component to accommodate a wide range of heating element interconnection arrangements. In addition to greatly reducing inventory requirements, this has the advantage of reducing production costs of the single housing section required. Furthermore, each housing section can be formed by known molding techniques, with all interior baffling and interlocking functions being accomplished by integral molded partitions provided therein. No additional retaining clips, insulating sleeves or alignment jigs are required.

Although the two housing sections snap together effortlessly, without the use of equipment or fixtures, once assembled they form a permanent assembly which completely seals and encapsulates the connection area, preventing accidental probes of the electrical connectors and premature disassembly and the possibility of an electrical hazard developing.

The simplicity of the assembly, plus the lack of additional clips, straps, retainers, and other fastening means or adapters, along with the capability of accommodating many different types of connections, render the terminal housing of the invention particularly advantageous in the replacement market, wherein many different types of interconnections are encountered.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A housing for use in enclosing the connections between first and second electrical conductors and the terminals of an electric resistance heating element, said housing comprising, in combination:

first and second identical interlocking electrically non-conductive housing sections, each of said housing sections including a base portion, and a side wall portion projecting from said base portion and forming a compartment therewith, and side wall portion having a rim, and means including a first pair of recesses on said rim for receiving in cooperation with a pair of like recesses on the other of said housing sections when said housing sections are locked together rim-to-rim respective ones of said electrical conductors, and means including a second pair of recesses on said rim opposite said first pair of recesses for receiving in cooperation with a pair of like recesses on the other of said housing sections when said housing are locked together rim-to-rim respective ends of said electrical resistance heating element, and means including a divider wall portion projecting above said rim from said base portion and extending through said compartment from a first location on said side wall portion between said first pair of recesses to a second location on said side wall portion between said second pair of recesses for dividing said compartment into first and second electrically-isolated sections, said divider wall portion being disposed parallel to and adjacent one side of a plane bisecting said compartment whereby said wall portion comes into substantially contiguous surface to surface engagement with the wall portion of the other of said housing sections when said housing sections are locked together rim-to-rim; and means including a locking tab portion projecting from said rim of said side wall portion, and a tab receiving portion disposed on said side wall portion opposite said tab portion for receiving a like tab portion on the other of said housing sections in locking engagement when the rims of said housing sections are brought into contact to lock said housing sections together about said connections.

2. A housing as defined in claim 1 wherein said housing sections are generally rectangular in form, said first pair of recesses is located on a first side wall thereof, said second pair of recesses is located on a second side wall thereof opposite said first side wall, said locking tab portion is located on a third side wall thereof, said tab receiving portion is located on a fourth side wall thereof opposite said third side wall, and said divider wall portion extends between said first and second side wall portions.

3. A housing as defined in claim 1 wherein said engaging surface along the edge of said projecting portion of said divider wall portion is tapered away from said bisecting plane.

* * * * *